US009239554B2

(12) United States Patent
Nakabayashi

(10) Patent No.: US 9,239,554 B2
(45) Date of Patent: Jan. 19, 2016

(54) IMAGE FORMING APPARATUS CONTROLLING HEATED REGION OF SHEET BY FIXING UNIT BASED ON SHEET WIDTH

(71) Applicant: CANON KABUSHIKI KAISHA, Tokyo (JP)

(72) Inventor: Junichiro Nakabayashi, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 113 days.

(21) Appl. No.: 14/016,663

(22) Filed: Sep. 3, 2013

(65) Prior Publication Data

US 2014/0064767 A1 Mar. 6, 2014

(30) Foreign Application Priority Data

Sep. 6, 2012 (JP) ..... 2012-196237
Aug. 5, 2013 (JP) ..... 2013-162391

(51) Int. Cl.
*G03G 15/20* (2006.01)

(52) U.S. Cl.
CPC ..... *G03G 15/2039* (2013.01); *G03G 15/2042* (2013.01)

(58) Field of Classification Search
CPC ..... G03G 15/2042
See application file for complete search history.

(56) References Cited

U.S. PATENT DOCUMENTS 5,787,321 A * 7/1998 Nishikawa ..... G03G 15/2042 165/205
7,065,315 B2 * 6/2006 Kinouchi et al. ..... 399/334
9,128,427 B2 * 9/2015 Nawa ..... G03G 15/2017
2001/0048822 A1 * 12/2001 Hanyu et al. ..... 399/67
2004/0190925 A1 * 9/2004 Baruch ..... G03G 15/2042 399/69
2011/0305492 A1 * 12/2011 Tamaki et al. ..... 399/323

(Continued)

FOREIGN PATENT DOCUMENTS

CN 1349620 A 5/2002
CN 101046666 A 10/2007

(Continued)

OTHER PUBLICATIONS

English machine translation of "Image Forming Apparatus", by Mogi (JP 2010-181468 A); published Aug. 19, 2010.*

(Continued)

*Primary Examiner* — David Gray
*Assistant Examiner* — Geoffrey Evans
(74) *Attorney, Agent, or Firm* — Canon U.S.A., Inc. IP Division

(57) ABSTRACT

An image forming apparatus includes an image forming unit, a heating member configured to heat the sheet for fixing the image onto the sheet, a temperature detection unit configured to detect a temperature of a predetermined position of the heating member, a controller configured to control the heating member, a heating region control unit configured to control the heated region of the heating member, wherein the heating region control unit controls a first and a second heated region, wherein the first heated region includes the predetermined position, and wherein the second heated region in the width direction includes the first heated region and an outer heated region outside the first heated region, and a cooling unit configured to cool the heated region, wherein if the heating region control unit changes the heated region from the first heated region to the second heated region, the cooling unit cools the predetermined position.

15 Claims, 9 Drawing Sheets

(56) References Cited

U.S. PATENT DOCUMENTS

| | | | | |
|---|---|---|---|---|
| 2012/0275813 | A1* | 11/2012 | Matsumoto | G03G 15/2028 399/92 |
| 2015/0010338 | A1* | 1/2015 | Miyagawa | G03G 21/206 399/341 |

FOREIGN PATENT DOCUMENTS

| | | | | |
|---|---|---|---|---|
| CN | 101424913 | A | | 5/2009 |
| CN | 101452248 | A | | 6/2009 |
| CN | 101458486 | A | | 6/2009 |
| CN | 101673078 | A | | 3/2010 |
| JP | 11054242 | A | * | 2/1999 |
| JP | 2005-055742 | A | | 3/2005 |
| JP | 2010-181468 | A | | 8/2010 |
| JP | 2010181468 | A | * | 8/2010 |
| JP | 2010-244023 | A | | 10/2010 |
| WO | 2005/038532 | A1 | | 4/2005 |

OTHER PUBLICATIONS

English machine translation of Japanese patent document, Adachi (JP 11-054242 A); "Heating Device and Image-Forming Device"; by Adachi, Nobukazu; published Feb. 26, 1999.*

* cited by examiner

IMAGE FORMING APPARATUS CONTROLLING HEATED REGION OF SHEET BY FIXING UNIT BASED ON SHEET WIDTH

BACKGROUND OF THE INVENTION

1. Field of the Invention

The present invention relates to a technique for fixing a toner image with heat onto a recording material.

2. Description of the Related Art

A fixing device of an electromagnetic induction heating system includes an endless heat generation member made of a magnetic metal, a coil positioned to face the heat generation member, and a pressing roller that is rotationally driven while being in press-contact with the heat generation member. Hereinafter, a region configured with the pressing roller which is in press-contact with the heat generation member will be referred to as a fixing nip portion. The fixing device applies electric current to the coil to create eddy currents in a surface of the heat generation member facing the coil, whereby the heat generation member generates heat due to Joule heat. When a recording material carrying an unfixed toner image is passed through the fixing nip portion while the fixing device controls the temperature of the heat generation member to maintain the temperature of the fixing nip portion at a predetermined temperature, the unfixed toner image is melted and fixed onto the recording material by the heat and pressure of the fixing nip portion.

When a plurality of recording materials is continuously passed through the fixing nip portion to fix toner images onto the recording materials, if the temperature of a sheet-passing region of the fixing nip portion that comes into contact with the recording materials is maintained at the predetermined temperature, the temperature of a non-sheet-passing region of the fixing nip portion that does not come into contact with the recording materials will increase excessively. This phenomenon occurs because heat in the sheet-passing region is likely to be conducted to a recording material passing through the sheet-passing region, whereas heat accumulated in the non-sheet-passing region is less likely to be conducted to a recording material passing through the fixing nip portion.

In view of the foregoing, a fixing device discussed in Japanese Patent Application Laid-Open No. 2005-55742 includes a shielding member configured to lower the magnetic flux density of a magnetic field created by the coil, and the shielding member is moved between a heat generation member and a coil to increase or decrease a shielding region. In the fixing device, the shielding member is moved to a position corresponding to the width of a recording material to decrease the magnetic flux density of a non-sheet-passing region, so that an excessive increase in the temperature of the non-sheet-passing region of the fixing nip portion is prevented.

The following describes a case in which the fixing device discussed in Japanese Patent Application Laid-Open No. 2005-55742 fixes a first toner image onto a first recording material having a first width and thereafter fixes a second toner image onto a second recording material having a second width that is wider than the first width. As used herein, the term "first sheet-passing region" refers to a region of the fixing nip portion that comes into contact with the first recording material. As used herein, the term "second sheet-passing region" refers to a region of the fixing nip portion that comes into contact with the second recording material. In the fixing device, when the shielding member is moved from a first position corresponding to the first sheet-passing region to a second position corresponding to the second sheet-passing region, the temperature of the entire second sheet-passing region does not reach a predetermined temperature at once. In other words, immediately after the shielding member is moved from the first position to the second position, a common region where the first sheet-passing region and the second sheet-passing region overlap each other is already at the predetermined temperature, whereas the temperature of a non-common region of the second sheet-passing region other than the common region remains lower than the predetermined temperature. Furthermore, after the shielding member is moved from the first position to the second position, the fixing device needs to adjust the amount of heat generation of the heat generation member such that the temperature of the common region does not reach or exceed an abnormal temperature that is higher than the predetermined temperature and the temperature of the non-common region reaches the predetermined temperature. Hence, the fixing device discussed in Japanese Patent Application Laid-Open No. 2005-55742 has a problem that it takes time for the temperature of the entire second sheet-passing region to reach the predetermined temperature after the shielding member is moved from the first position to the second position.

SUMMARY OF THE INVENTION

An image forming apparatus includes an image forming unit configured to form an image on a sheet, a heating member configured to heat the sheet conveyed from the image forming unit for fixing the image onto the sheet, a temperature detection unit configured to detect a temperature of a predetermined position of a heated region of the heating member, a controller configured to control the heating member based on the temperature detected by the temperature detection unit, and a heating region control unit configured to control the heated region of the heating member based on a width of the sheet in a width direction orthogonal to a conveyance direction in which the sheet is conveyed. The heating region control unit controls a first heated region if the width of the sheet is equal to or narrower than a predetermined width, and controls a second heated region if the width of the sheet is wider than the predetermined width. The first heated region includes the predetermined position, and the second heated region in the width direction includes the first heated region and an outer heated region outside the first heated region. Further, an image forming apparatus includes a cooling unit configured to cool the heated region, wherein if the heating region control unit changes the heated region from the first heated region to the second heated region, the cooling unit cools the predetermined position.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
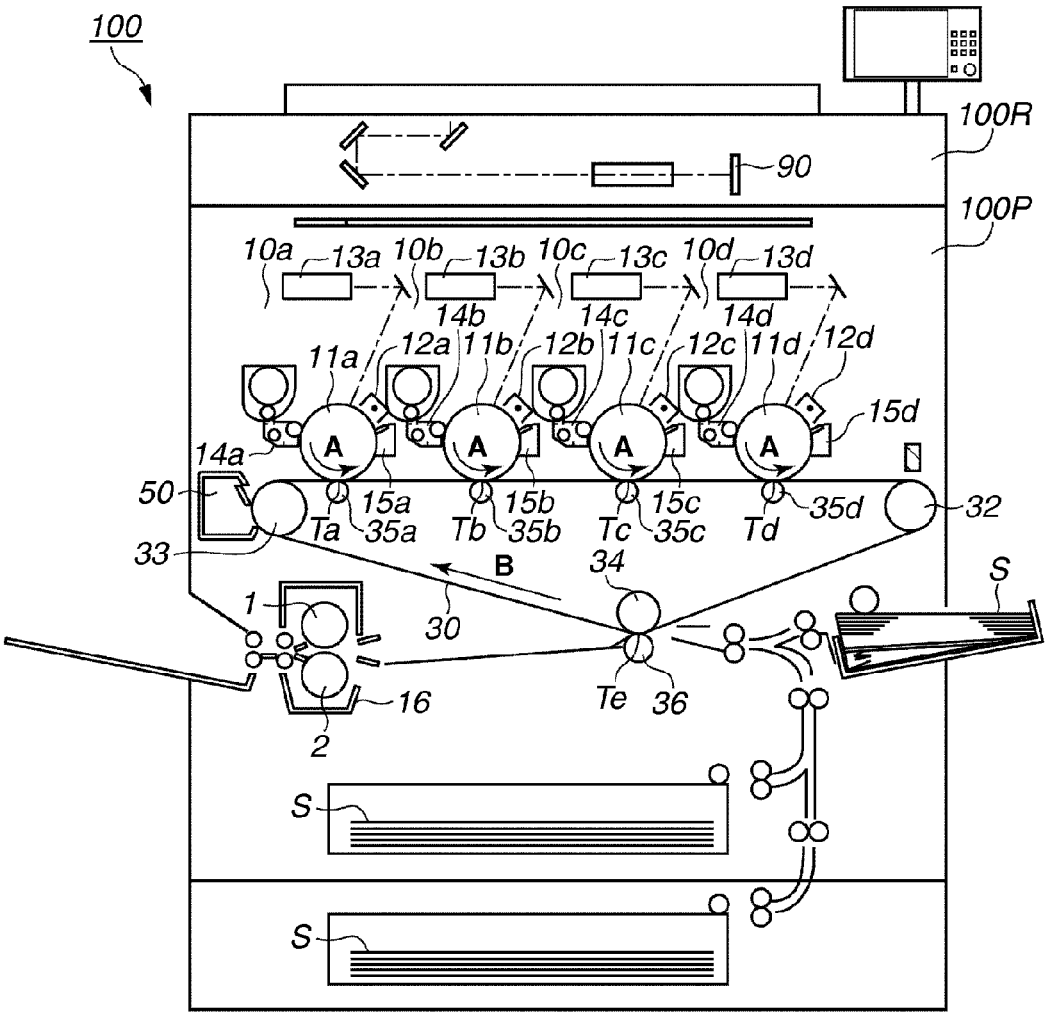
FIG. 1 is a schematic view of a main portion of an image forming apparatus according to a first exemplary embodiment.

FIG. 1 is a schematic cross sectional view illustrating an image forming apparatus 100 according to a first exemplary embodiment. In the image forming apparatus 100 according to the present exemplary embodiment, an image read by a reader unit 100R can be formed on a recording material by a printer unit 100P. The printer unit 100P of the present exemplary embodiment includes four image forming units 10*a*, 10*b*, 10*c*, and 10*d* arranged on a line. The image forming unit 10*a* forms yellow toner images. The image forming unit 10*b* forms magenta toner images. The image forming unit 10*c* forms cyan toner images. The image forming unit 10*d* forms black toner images.

The image forming unit 10*a* includes a charging unit 12*a*, an exposure device 13*a*, a developing unit 14*a*, a transfer roller 35*a*, and a drum cleaner 15*a* around a photosensitive drum 11*a*, which carries a yellow toner image. The charging unit 12*a* charges the photosensitive drum 11*a*. The exposure device 13*a* exposes the photosensitive drum 11*a* based on image data corresponding to a yellow color component to form an electrostatic latent image corresponding to the yellow color component on the photosensitive drum 11*a*. The developing unit 14*a* visualizes as a toner image the electrostatic latent image formed on the photosensitive drum 11*a* by use of a developer including toner. The transfer roller 35*a* transfers onto an intermediate transfer belt 30 the yellow-component toner image carried by the photosensitive drum 11*a*. The drum cleaner 15*a* removes residual toner remaining on the photosensitive drum 11*a*. The image forming units 10*b*, 10*c*, and 10*d* have the same structure as that of the image forming unit 10*a*. Hence, description of the image forming units 10*b*, 10*c*, and 10*d* is omitted.

The intermediate transfer belt 30 is an image bearing member that carries a toner image. Toner images of the respective color components formed by the image forming units 10*a*, 10*b*, 10*c*, and 10*d* are placed on top of another and held on the intermediate transfer belt 30 to form a full-color toner image. The intermediate transfer belt 30 is supported a driving roller 32, a driven roller 33, and a roller 34 described below. The driving roller 32 rotates and drives the intermediate transfer belt 30 in the direction of arrow B indicated in FIG. 1.

A transfer nip portion Ta is where the transfer roller 35*a* presses the photosensitive drum 11*a* via the intermediate transfer belt 30. A transfer nip portion Tb is where the transfer roller 35*b* presses the photosensitive drum 11*b* via the intermediate transfer belt 30. A transfer nip portion Tc is where the transfer roller 35*c* presses the photosensitive drum 11*c* via the intermediate transfer belt 30. A transfer nip portion Td is where the transfer roller 35*d* presses the photosensitive drum 11*d* via the intermediate transfer belt 30.

A transfer roller 36 is provided in the intermediate transfer belt 30 to transfer a toner image formed on the intermediate transfer belt 30 onto a recording material P such as a paper sheet. A transfer nip portion Te is where the transfer roller 36 presses the roller 34 via the intermediate transfer belt 30. A belt cleaner 50 removes residual toner that has not been transferred from the intermediate transfer belt 30 onto the recording material P and remains on the intermediate transfer belt 30.

In the reader unit 100R, when a user places a document on a platen and presses a copy button, a light source emits light. The light is reflected by the document, and an image sensor 90 receives the reflected light via a reflecting mirror. When receiving the reflected light from the document, the image sensor 90 generates data for each of the color components R (red), G (green), and B (blue). A central processing unit (CPU) 201 (FIG. 4) converts the data of each of the color components R (red), G (green), and B (blue) into image data for forming a toner image of color components yellow, magenta, cyan, and black. The image data is transferred to the exposure devices 13*a*, 13*b*, 13*c*, and 13*d* of the image forming units 10*a*, 10*b*, 10*c*, and 10*d*.

The following describes an image formation operation of the image forming apparatus 100 of the present exemplary embodiment to output a printed matter corresponding to image data transferred from a personal computer (PC), which is not illustrated, or the image sensor 90.

In the image forming units 10*a*, 10*b*, 10*c*, and 10*d*, first, the charging units 12*a*, 12*b*, 12*c*, and 12*d* uniformly charge the photosensitive drums 11*a*, 11*b*, 11*c*, and 11*d*. Then, the exposure devices 13*a*, 13*b*, 13*c*, and 13*d* irradiate the photosensitive drums 11*a*, 11*b*, 11*c*, and 11*d* with light corresponding to the image data of each of the color components, whereby an electrostatic latent image corresponding to the image data of each of the color components is formed. Thereafter, the developing units 14*a*, 14*b*, 14*c*, and 14*d* visualize the electrostatic latent images formed on the photosensitive drums 11*a*, 11*b*, 11*c*, and 11*d* in the form of toner images of the respective color components.

The photosensitive drums 11*a*, 11*b*, 11*c*, and 11*d* are rotated to convey the toner images of the respective color components on the photosensitive drums 11*a*, 11*b*, 11*c*, and 11*d* to the transfer nip portions Ta, Tb, Tc, and Td. At the transfer nip portions Ta, Tb, Tc, and Td, the transfer rollers 35*a*, 35*b*, 35*c*, and 35*d* apply a transfer voltage to the toner images of the respective color components on the photosensitive drums 11*a*, 11*b*, 11*c*, and 11*d* so that the toner images are sequentially transferred on top of another onto the intermediate transfer belt 30 to form a full-color toner image on the intermediate transfer belt 30. The drum cleaners 15*a*, 15*b*, 15*c*, and 15*d* remove residual toner remaining on the photosensitive drums 11*a*, 11*b*, 11*c*, and 11*d*.

The intermediate transfer belt 30 is rotated in the direction of arrow B to convey the full-color toner image transferred onto the intermediate transfer belt 30 to the transfer nip portion Te. Meanwhile, a recording material S is conveyed to the transfer nip portion Te at an adjusted timing to come into contact with the full-color toner image. The transfer roller 36 to which the transfer voltage has been applied transfers the full-color toner image formed on the intermediate transfer belt 30 onto the recording material S. The belt cleaner 50 removes residual toner that has not been transferred onto the recording material S at the transfer nip portion Te and remains on the intermediate transfer belt 30.

When the recording material S carrying the toner image is conveyed to a fixing device 16, the fixing device 16 applies heat and pressure to the recording material S carrying the unfixed toner image to melt and fix the unfixed toner image onto the recording material S.

Figure 2:
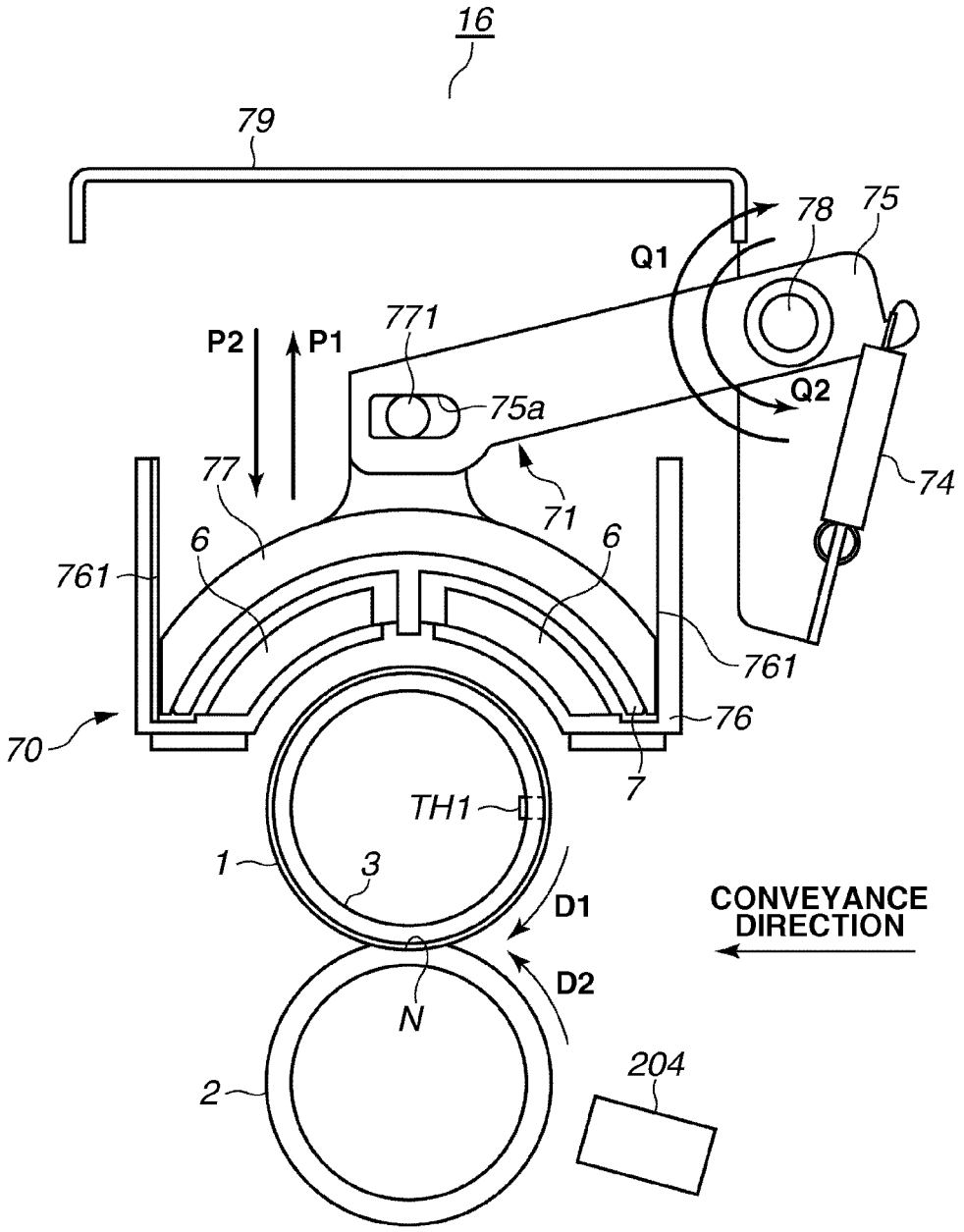
FIG. 2 is a schematic cross sectional view of a fixing device according to the first exemplary embodiment.

The following describes a structure of the fixing device 16 of the present exemplary embodiment with reference to FIG. 2 illustrating a schematic cross sectional view of the fixing device 16. The fixing device 16 includes a fixing belt 1, a pressing roller 2, an induction heating device 70, and a fan 204. The fixing belt 1 is an endless fixing belt including a metal layer. The pressing roller 2 includes an iron-alloy core bar and a silicone-rubber elastic layer provided on the core bar. The induction heating device 70 heats the fixing belt 1 by induction heating. The fan 204 cools the pressing roller 2. The fixing belt 1 is cylindrical. A width direction that is orthogonal to the direction in which a peripheral surface of the fixing belt 1 is moved is parallel to an axial direction of the pressing roller 2.

The image forming apparatus 100 conveys the recording material S to the fixing device 16 such that the center of the recording material S in the direction that is orthogonal to a conveyance direction passes through a reference position of the pressing roller 2. The reference position is a central position of the pressing roller 2 in the axial direction of the pressing roller 2. The conveyance direction is the direction in which a recording material S is conveyed from the transfer nip portion Te to the fixing device 16. Hereinafter, the direction in which a recording material S is conveyed will be referred to as a first direction, and the direction that is orthogonal to the conveyance direction will be referred to as a second direction. Accordingly, the width direction that is orthogonal to the direction in which the peripheral surface of the fixing belt 1 is moved is also the second direction, and the axial direction of the pressing roller 2 is also the second direction.

Inside the fixing belt 1 is provided a pat 3. The pat 3 is in contact with an inner peripheral surface of the fixing belt 1 and fixed to a frame (not illustrated). The pressing roller 2 presses the fixing belt 1 to form a fixing nip portion N. While being in press-contact with the fixing belt 1, the pressing roller 2 is rotationally driven in the direction of arrow D2 by a motor M1 (FIG. 4) to rotationally drive the fixing belt 1 in the direction of arrow D1. Since the pat 3 is fixed to the frame (not illustrated), when the fixing belt 1 is rotated in the direction of arrow D1, the pat 3 is not rotated together with the fixing belt 1.

On the inner peripheral surface of the fixing belt 1 is provided a thermistor TH1. The thermistor TH1 detects a temperature of a first position at a center of the fixing belt 1 in the second direction. The thermistor TH1 is disposed near the inner peripheral surface of the fixing belt 1 by use of a frame (not illustrated), so that the thermistor TH1 is not rotated together with the fixing belt 1 when the fixing belt 1 is rotated.

The induction heating device 70 includes an excitation coil member 6, a plurality of magnetic cores 7, and a plurality of core moving mechanisms 71. The excitation coil member 6 includes a litz wire wound around the coil member 6. The magnetic cores 7 control the magnetic flux density of the excitation coil member 6. The magnetic cores 7 are independently moved close to the excitation coil member 6 and separated from the excitation coil member 6 by the core moving mechanisms 71. The excitation coil member 6 is bent to be U-shaped and disposed to face a portion of the peripheral surface of the fixing belt 1 at a predetermined distance from the portion. When electric current is supplied to the excitation coil member 6 from an excitation circuit 205 (FIG. 4), the excitation coil member 6 creates a magnetic field to generate eddy currents at the metal layer of the fixing belt 1, so that the metal layer of the fixing belt 1 produces heat. The fixing belt 1 corresponds to an endless heat generation unit that produces heat caused by eddy currents.

The induction heating device 70 heats the fixing belt 1 by induction heating such that a temperature T1 of the fixing belt 1 detected by the thermistor TH1 reaches a target temperature. When the temperature T1 of the fixing belt 1 detected by the thermistor TH1 reaches a target range including the target temperature, a recording material S carrying an unfixed toner image is conveyed to the fixing nip portion N. The fixing device 16 nips the recording material S at the fixing nip portion N and conveys the recording material S. The fixing device 16 melts an unfixed toner image held on the recording material S and fixes the unfixed toner image on the recording material S by use of heat of the fixing belt 1 and pressure applied to the fixing nip portion N. The CPU 201 sets the target temperature and the target range based on the recording material S. The CPU 201 may set the target temperature and the target range based on the size of the recording material S, the temperature of the fixing device 16, or the humidity.

The fixing belt 1 corresponds to a heating member that heats the recording material S. The pressing roller 2 corresponds to a pressing member that presses the fixing belt 1 to form the fixing nip portion N.

The magnetic cores 7 and the core moving mechanisms 71 are arranged to form a line in the second direction. In the present exemplary embodiment, one core moving mechanism 71 is provided in each magnetic core 7. However, the structure of the core moving mechanisms 71 is not limited to that of the present exemplary embodiment. For example, two or more magnetic cores 7 may be moved close to the excitation coil member 6 and separated from the excitation coil member 6 by one core moving mechanism 71.

The magnetic cores 7 are core members that increase the magnetic flux density of the excitation coil member 6. Each core moving mechanism 71 moves a core holder 77, which holds the magnetic core 7, in the direction of arrow P2 to move the magnetic core 7 close to the excitation coil member 6, thereby increasing the magnetic flux density of magnetic flux passing through the fixing belt 1 facing the excitation coil member 6 to which the magnetic core 7 has come close. Further, each core moving mechanism 71 moves the core holder 77, which holds the magnetic core 7, in the direction of arrow P1 to separate the magnetic core 7 from the excitation coil member 6, thereby reducing the magnetic flux density of magnetic flux passing through the fixing belt 1 facing the excitation coil member 6 from which the magnetic core 7 has been separated.

When a toner image is to be fixed onto a recording material Shaving a width in the second direction that is equal to or narrower than a predetermined width L, the induction heating device 70 separates from the excitation coil member 6 the magnetic cores 7 that face a region of a first length from one end portion of the excitation coil member 6 in the second direction, and the magnetic cores 7 that face a region of a second length from another end portion of the excitation coil member 6 in the second direction. This prevents accumulation of heat in a non-sheet-passing region of the fixing belt 1 that is not brought into contact with a plurality of recording materials S having a width in the second direction that is equal to or narrower than the predetermined width L when the recording materials S consecutively pass through the fixing nip portion N. The accumulated heat causes deterioration of the fixing belt 1 and the pressing roller 2.

The fan 204 supplies air to a predetermined region of the pressing roller 2 facing a first region of the fixing belt 1 that is brought into contact with a recording material S having the predetermined width L. This lowers the temperature of the predetermined region of the pressing roller 2. As the pressing roller 2 is rotated, the predetermined region of the pressing roller 2 with a lowered temperature is brought into contact with the first region of the fixing belt 1 to lower the temperature of the first region of the fixing belt 1. The first region of the fixing belt 1 is, for example, a central region of predetermined width of the fixing belt 1 in the second direction.

When a detected temperature of the thermistor TH1 provided at the first position of the fixing belt 1 in the second direction becomes lower than a predetermined temperature (e.g., lower limit of target range) required to fix toner, as a result of the air supply from the fan 204, the excitation circuit 205 (FIG. 4) increases the amount of electric current supplied to the excitation coil member 6 to increase the amount of heat generation of the fixing belt 1. Thus, while the fan 204 indirectly cools the first region of the fixing belt 1, the temperature of the first region of the fixing belt 1 is maintained within the target range. Meanwhile, the temperature of a second region of the fixing belt 1 increases. The second region of the fixing belt 1 is, for example, a region from an inner position of a predetermined length from an end portion of the fixing belt 1 in the second direction, to the first region of the fixing belt 1 in the second direction. In other words, the second region of the fixing belt 1 is a region closer to the end portion of the fixing belt 1 in the second direction than the first region of the fixing belt 1 in the second direction.

Figure 3A:
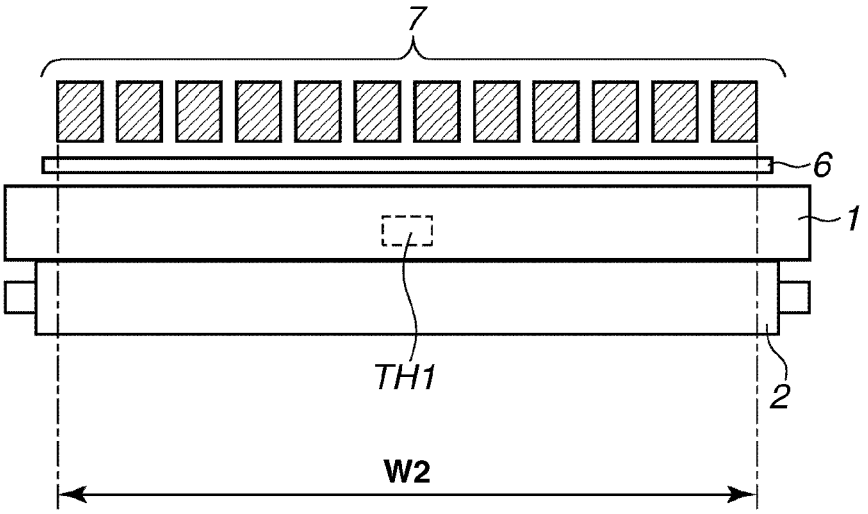
FIGS. 3A and 3B are schematic views of a main portion of the fixing device according to the first exemplary embodiment.
Figure 3B:
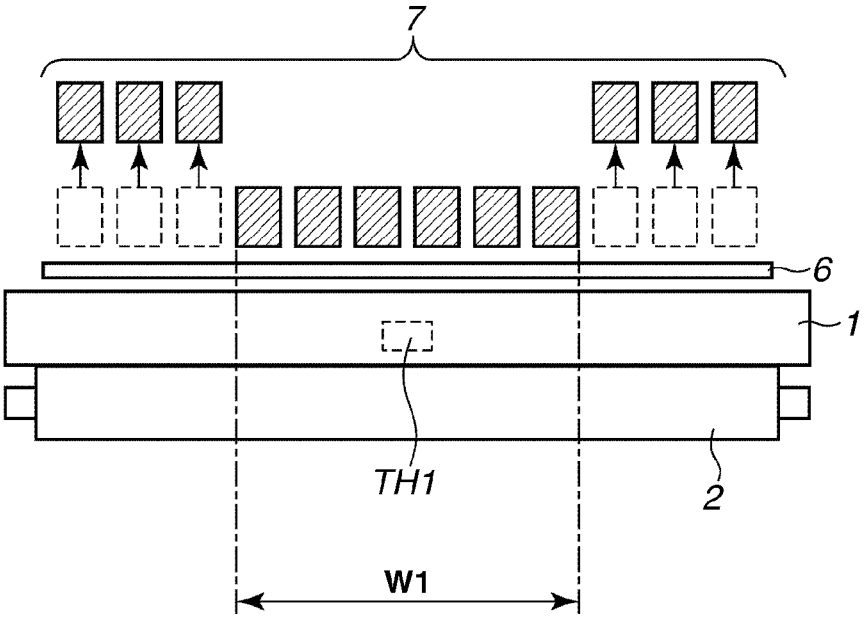

Before a recording material S arrives at the fixing nip portion N, the induction heating device 70 sets a heated region where the fixing belt 1 heats the recording material S based on the width of the recording material S in the second direction. FIG. 3A is a schematic view of a main portion of the induction heating device 70 controlling the width of the heated region to be a width W2. FIG. 3B is a schematic view of the main portion of the induction heating device 70 controlling the width of the heated region to be a width W1. As illustrated in FIG. 3B, the magnetic cores 7 that correspond to the width W1 of the heated region in the second direction come close to the excitation coil member 6, while the magnetic cores 7 that are positioned outside the width W1 of the heated region in the second direction are separated from the excitation coil member 6.

When the width of a recording material S in the second direction that is conveyed to the fixing nip portion N is equal to or narrower than the predetermined width L, the width of the heated region in the second direction is set to the width W1. The heated region of the width W1 corresponds to a first heated region (first heat generation region) for fixing a toner image onto a first recording material having a width in the second direction that is equal to or narrower than the predetermined width L. The first heated region may also be referred to as a first heat generation region where the fixing belt 1 generates heat, because the region of the fixing belt 1 of the width W1 generates heat.

On the other hand, when the width of a recording material S in the second direction that is conveyed to the fixing nip portion N is wider than the predetermined width L, the width of the heated region in the second direction is set to the width W2. The heated region of the width W2 corresponds to a second heated region (second heat generation region) for fixing a toner image onto a second recording material having a width in the second direction that is wider than the predetermined width L. The width W2 of the second heated region is equal to or wider than a width of a recording material S of a maximum size in the second direction that can be conveyed by the image forming apparatus 100. The second heated region may also be referred to as a second heat generation region where the fixing belt 1 generates heat, because the region of the fixing belt 1 of the width W2 generates heat.

The following describes a case in which a second recording material S2 of a width in the second direction that is wider than the predetermined width L is conveyed to the fixing nip portion N while the width of the heated region in the second direction is controlled to be the width W1, as illustrated in FIG. 3B. Before the second recording material S2 of a width in the second direction that is wider than the predetermined width L is conveyed to the fixing nip portion N, the width of the heated region in the second direction is changed from the width W1 to the width W2 illustrated in FIG. 3A. At this time, it is not possible to fix a toner image onto a second recording material S2 until the temperature of the second region of the fixing belt 1 reaches the target range. Therefore, the fixing device 16 of the present exemplary embodiment increases the width of the heated region in the second direction from the width W1 to the width W2 and cools the predetermined region of the pressing roller 2 by use of the fan 204. This increases the amount of generated heat in the second region of the fixing belt 1, which shortens a time required for the temperature of the entire region of the width W2 to reach the target range.

The following describes the core moving mechanisms 71 provided in the induction heating device 70, in detail with reference to FIG. 2. The core moving mechanisms 71 move the magnetic cores 7 close to the excitation coil member 6 and separate the magnetic cores 7 from the excitation coil member 6. Each core moving mechanism 71 includes a housing 76, the core holder 77, a linking member 75, a solenoid 74, and a frame 79. The housing 76 accommodates the excitation coil member 6 and the magnetic core 7. The core holder 77 holds the magnetic cores 7. The linking member 75 is coupled to the core holder 77. The solenoid 74 rotates the linking member 75 about a rotation shaft 78 in the direction of arrow Q1 or Q2.

An elongated hole portion 75*a* of the linking member 75 is coupled to a coupling protrusion 771 of the core holder 77. When the linking member 75 is rotated in the direction of arrow Q1, the core holder 77 and the magnetic core 7 are guided by a guide member 761 of the housing 76 to move in the direction of arrow P1. When the linking member 75 is rotated in the direction of arrow Q2, the core holder 77 and the magnetic core 7 are guided by the guide member 761 of the housing 76 to move in the direction of arrow P2.

When electric current is supplied to the solenoid 74, the solenoid 74 moves the linking member 75 in the direction of arrow Q1. The solenoids 74 outside the width of the heated region in the second direction move the respective linking members 75 coupled to the solenoids 74 in the direction of arrow Q1, thereby separating the magnetic cores 7 outside the width of the heated region in the second direction from the excitation coil member 6. This decreases magnetic flux generated by the excitation coil member 6 facing the magnetic cores 7 outside the width of the heated region in the second direction, so that the amount of heat generation in the region of the fixing belt 1 that faces the excitation coil member 6 is decreased.

When the supply of electric current to the solenoid 74 is stopped, the solenoid 74 moves the linking member 75 in the direction of arrow Q2. The solenoids 74 inside the width of the heated region in the second direction move the respective linking members 75 coupled to the solenoids 74 in the direction of arrow Q2, thereby moving the magnetic cores 7 inside the width of the heated region in the second direction close to the excitation coil member 6. This increases magnetic flux generated by the excitation coil member 6 facing the magnetic cores 7 inside the width of the heated region in the second direction, so that the amount of heat generation in the region of the fixing belt 1 that faces the excitation coil member 6 is increased.

Figure 4:
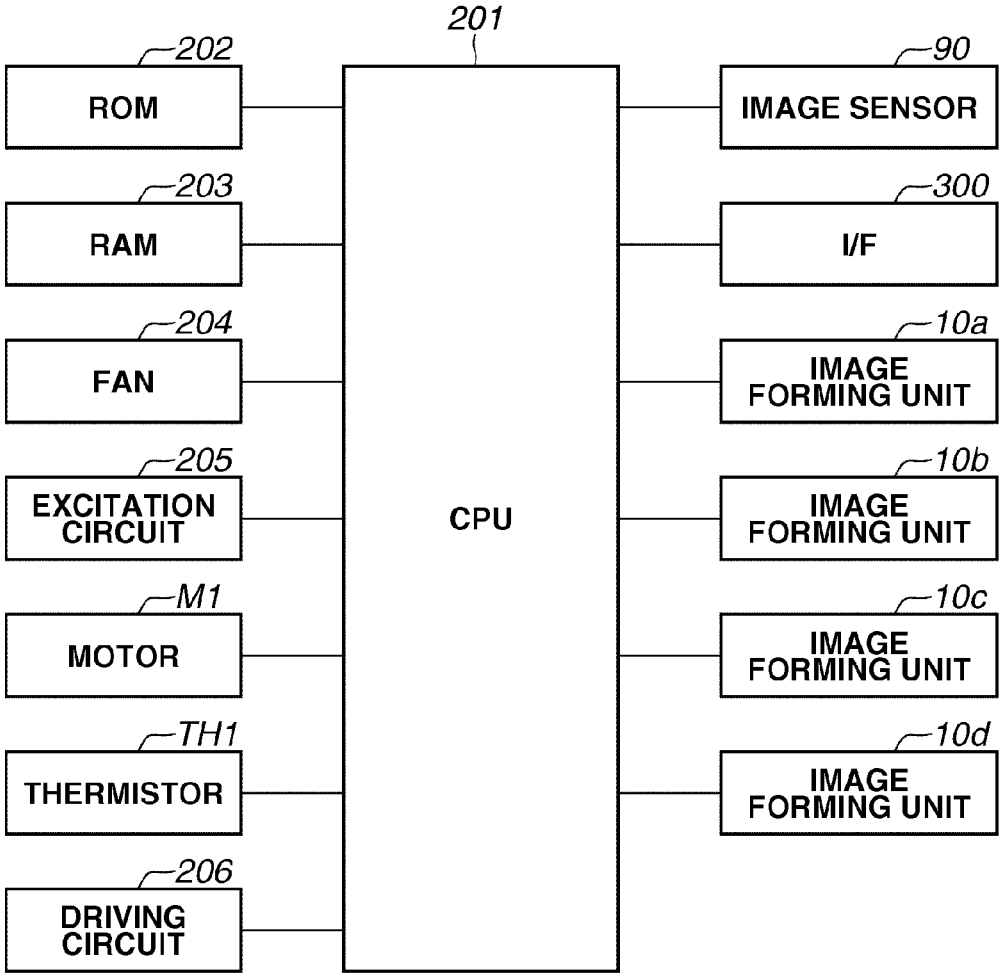
FIG. 4 is a control block diagram of the image forming apparatus according to the first exemplary embodiment.

FIG. 4 is a control block diagram of the image forming apparatus 100 of the present exemplary embodiment.

The CPU 201 is a control circuit configured to control the entire image forming apparatus 100. A read only memory (ROM) 202 stores control programs configured to control various types of processing to be executed in the image forming apparatus 100. A random access memory (RAM) 203 is a system work memory used by the CPU 201 to execute processing. The CPU 201 analyzes image information transferred via an interface (I/F) unit connected to an external apparatus such as a PC and rasterizes image data to acquire size information on the size of a recording material S on which an image corresponding to the image data is to be formed.

When the fan 204 receives a driving signal input from the CPU 201, the fan 204 supplies air to the predetermined region of the pressing roller 2. When the fan 204 receives a stop signal from the CPU 201, the fan 204 stops the air supply.

In response to a control signal from the CPU 201, the excitation circuit 205 switches the frequency of electric current supplied to the excitation coil member 6. The closer the frequency of the electric current supplied to the excitation coil member 6 is to the resonance frequency, the more amount of heat the fixing belt 1 generates.

In response to a signal from the CPU 201, the motor M1 rotationally drives the pressing roller 2 at a predetermined rotation speed. The fixing belt 1 is rotationally driven by the pressing roller 2.

The thermistor TH1 detects a temperature of the first position of the fixing belt 1 to output temperature information on the detected temperature to the CPU 201. Based on the temperature information on the detected temperature output by the thermistor TH1, the CPU 201 controls the frequency of electric current to be input to the excitation coil member 6 by use of the excitation circuit 205 such that the detected temperature becomes a target temperature.

A driving circuit 206 supplies electric current to the solenoids 74 positioned outside the width of the heated region in the second direction to rotate the respective linking members 75 coupled to the solenoids 74 in the direction of arrow Q1 (FIG. 2), thereby separating the magnetic cores 7 from the excitation coil member 6. The driving circuit 206 stops supplying electric current to the solenoids 74 to rotate the respective linking members 75 coupled to the solenoids 74 in the direction of arrow Q2 (FIG. 2), thereby moving the magnetic cores 7 to a position close to the excitation coil member 6. In other words, the driving circuit 206 supplies electric current to the solenoids 74 configured to move the magnetic cores 7 positioned outside the heated region, thereby controlling the width of the heated region of the fixing belt 1 in the second direction.

Based on a document read by the reader unit 100R, the image sensor 90 generates image data for forming a toner image of each color component and transfers the generated image data to the CPU 201.

The I/F 300 transmits image data input via an external apparatus such as a scanner and a PC to the CPU 201.

The image forming units 10*a*, 10*b*, 10*c*, and 10*d* are already described above with reference to FIG. 1, so description of the image forming units 10*a*, 10*b*, 10*c*, and 10*d* is omitted in this section.

Figure 5:
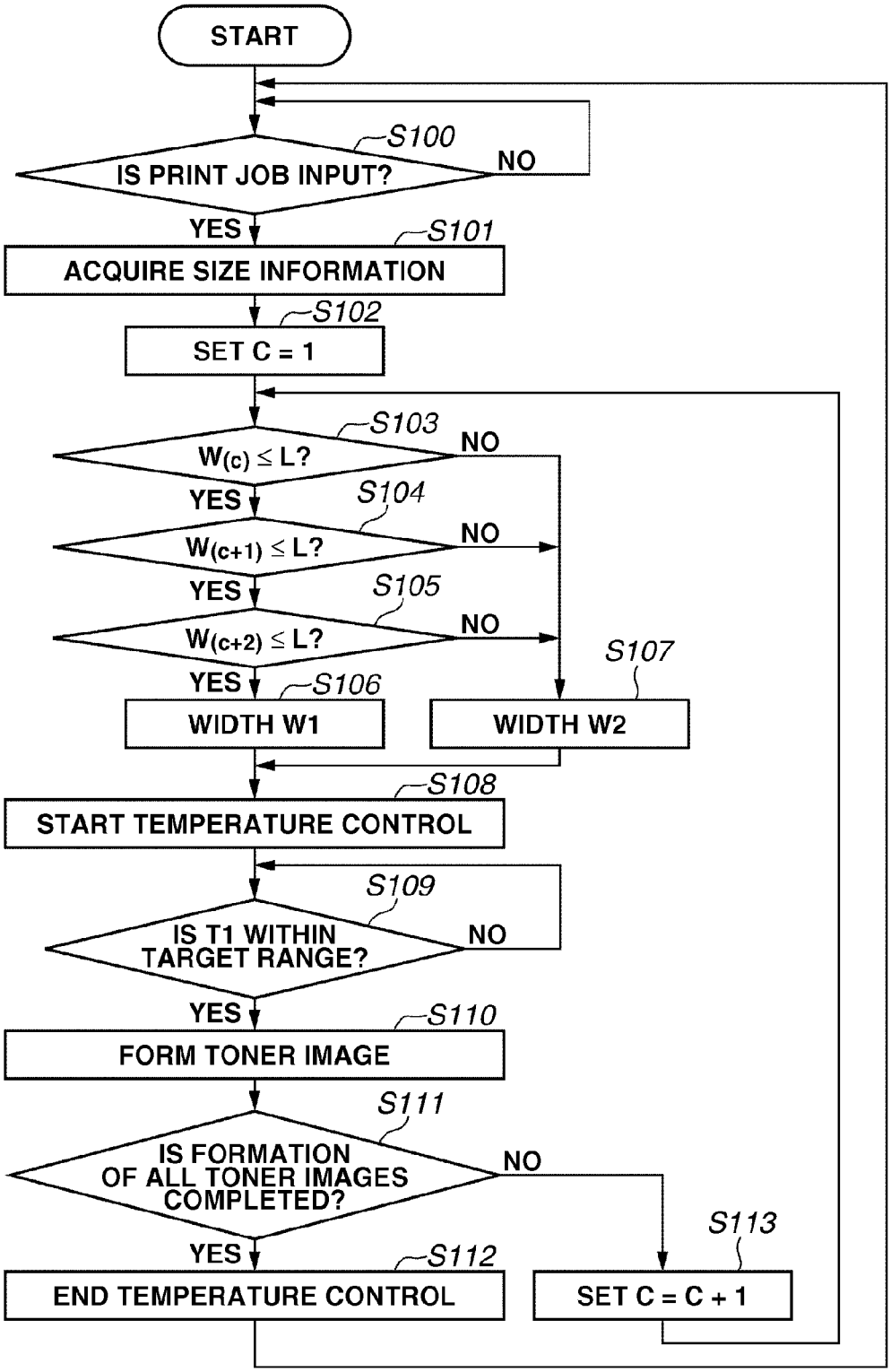
FIG. 5 is a flow chart illustrating image formation processing according to the first exemplary embodiment.

FIG. 5 is a flow chart illustrating an operation of the CPU 201 (FIG. 4) at the time when the image forming apparatus 100 of the present exemplary embodiment forms an image. The CPU 201 (FIG. 4) reads a program stored in the ROM 202 (FIG. 4) to execute the processing of the flow chart illustrated in FIG. 5.

When a main power source of the image forming apparatus 100 is turned on, the CPU 201 stands by until a print job is input via the image sensor 90 or the I/F 300. In step S100, if a print job is input to the image forming apparatus 100, the CPU 201 analyzes image information on image data transferred from the image sensor 90 or the I/F 300 to acquire size information on the size of a recording material S on which an image is to be formed. In step S101, the CPU 201 functions as an acquisition unit configured to acquire the size information on the width of the recording material S in the second direction.

In step S102, the CPU 201 sets to 1 the value of the counter C, which counts the number of pages of the print job.

Thereafter, based on the size information acquired in step S101 on the recording material S on which the image is to be formed, the CPU 201 determines whether a width W(c) of a recording material S on which an image on page C is to be formed is equal to or narrower than the predetermined width L. That is to say, in step S103, the CPU 201 determines, based on the size information on the recording material S on which the image on page C is to be formed, the width W(c) of the recording material S in the second direction on which the image on page C is to be formed.

If the width W(c) of the recording material S on which the image on page C is to be formed is wider than the predetermined width L, then the CPU 201 controls the driving circuit 206 to set the width of the heated region in the second direction to the width W2 (FIG. 3A). In other words, the CPU 201 sets the second heated region as the heated region. In step S107, the CPU 201 controls the driving circuit 206 to stop the supply of electric current to every solenoid 74. The linking members 75 coupled to the solenoids 74 which stops receiving the supply of electric current, hold all magnetic cores 7 near the excitation coil member 6, whereby the width of the heated region in the second direction is controlled to be the width W2.

In step S103, if the width W(c) of the recording material S on which the image on page C is to be formed is equal to or narrower than the predetermined width L, then the CPU 201 determines whether a width W(c+1) of a recording material S on which an image on page C+1 is to be formed is equal to or narrower than the predetermined width L. That is to say, in step S104, the CPU 201 detects the width W(c+1) of the recording material S in the second direction on which the image on page C+1 is to be formed, based on size information on the recording material S on which the image on page C+1 is to be formed. If the width W(c+1) of the recording material S on which the image on page C+1 is to be formed is wider than the predetermined width L, then the CPU 201 proceeds to step S107 described above.

In step S104, if the width W(c+1) of the recording material S on which the image on page C+1 is to be formed is equal to or narrower than the predetermined width L, then the CPU 201 determines whether a width W(c+2) of a recording material S on which an image on page C+2 is to be formed is equal to or narrower than the predetermined width L. That is to say, in step S105, the CPU 201 detects the width W(c+2) of the recording material S in the second direction on which the image on page C+2 is to be formed, based on the size information on the recording material S on which the image on page C+2 is to be formed. If the width W(c+2) of the recording material S on which the image on page C+2 is to be formed is wider than the predetermined width L, then the CPU 201 proceeds to step S107.

In step S105, if the width W(c+2) of the recording material S on which the image on page C+2 is to be formed is equal to or narrower than the predetermined width L, then the CPU 201 controls the driving circuit 206 to make the width of the heated region in the second direction, the width W1 (FIG. 3B). In other words, the CPU 201 sets the first heated region as the heated region. In step S106, the CPU 201 controls the driving circuit 206 to supply electric current to the solenoids 74 positioned outside the width W1 of the heated region in the second direction. The linking members 75 coupled to the solenoids 74 to which electric current is supplied separate the magnetic cores 7 outside the width W1 of the heated region in the second direction from the excitation coil member 6, whereby the width of the heated region of the fixing belt 1 in the second direction is controlled to be the width W1.

In step S106 or S107, the CPU 201 functions as a second control unit configured to control the width of the heated region in the second direction by controlling the driving circuit 206 to drive the solenoids 74.

After the CPU 201 controls the width of the heated region in the second direction, the CPU 201 starts temperature control. In step S108, when the CPU 201 starts the temperature control, the CPU 201 controls the frequency of electric current supplied to the excitation coil member 6 by use of the excitation circuit 205 such that a temperature T1 of the first position of the fixing belt 1 detected by the thermistor TH1 is in the target range. The fixing belt 1 corresponds to an endless heat generation member. The CPU 201 functions as a first control unit configured to control the temperature of the first region of the fixing belt 1 to be a target temperature by controlling the frequency of electric current supplied to the excitation coil member 6 by use of the excitation circuit 205.

In step S109, the CPU 201 stands by until the temperature T1 of the first position of the fixing belt 1 detected by the thermistor TH1 falls within the target range. Regardless of whether the width of the recording material S in the second direction is equal to or narrower than the predetermined width L, the recording material S is conveyed to pass through the reference position. In other words, the thermistor TH1 functions as a first temperature detection unit configured to detect the temperature of the first position at the center of the fixing belt 1 in the second direction.

In step S109, if the detected temperature T1 of the thermistor TH1 is within the target range, then the CPU 201 proceeds to step S110 to form the toner image on page C of the print job on the recording material S through the image formation operation and fix the toner image onto the recording material S by use of the fixing device 16.

In step S111, the CPU 201 determines whether formation of all toner images to be formed is completed. If formation of all toner images to be formed is completed, then in step S112, the CPU 201 controls the excitation circuit 205 to stop the supply of power to the excitation coil member 6 to end the temperature control. Then, the CPU 201 proceeds to step S100.

In step S111, if formation of all toner images to be formed is not completed, then the CPU 201 proceeds to step S113. In step S113, the CPU 201 increases the value of the counter C by 1, and then the CPU 201 proceeds to step S103 to start controlling the width of the heated region in the second direction based on the width of a recording material S on which a next image is to be formed.

In the fixing device 16 of the present exemplary embodiment, as described above, when the width of the heated region in the second direction that is controlled to be the width W1 is increased to the width W2, the fixing belt 1 is controlled to generate heat while the fan 204 cools the predetermined region of the pressing roller 2 to shorten a time required to increase the temperature of the entire region of the width W2 to the predetermined temperature.

In the present exemplary embodiment, it is assumed that a period from the time when the width is changed from the width W1 to the width W2 to the time when the temperature of the entire region of the width W2 is increased to the predetermined temperature is substantially equal to a period from the time when formation of a first image to be fixed onto a recording material S is started to the time when a recording material S onto which an image on the third page from the page of the first image is transferred reaches the fixing nip portion N. Thus, in steps S103 to S105, if the width of each of the recording materials S in the second direction on which the images on three pages from page C to page C+2 are to be formed is wider than the predetermined width L, the width of the heated region in the second direction is changed in advance to the width W2. Accordingly, the timing of the start of the change of the width is selected as appropriate according to a temperature of the fixing belt 1.

Figure 6:
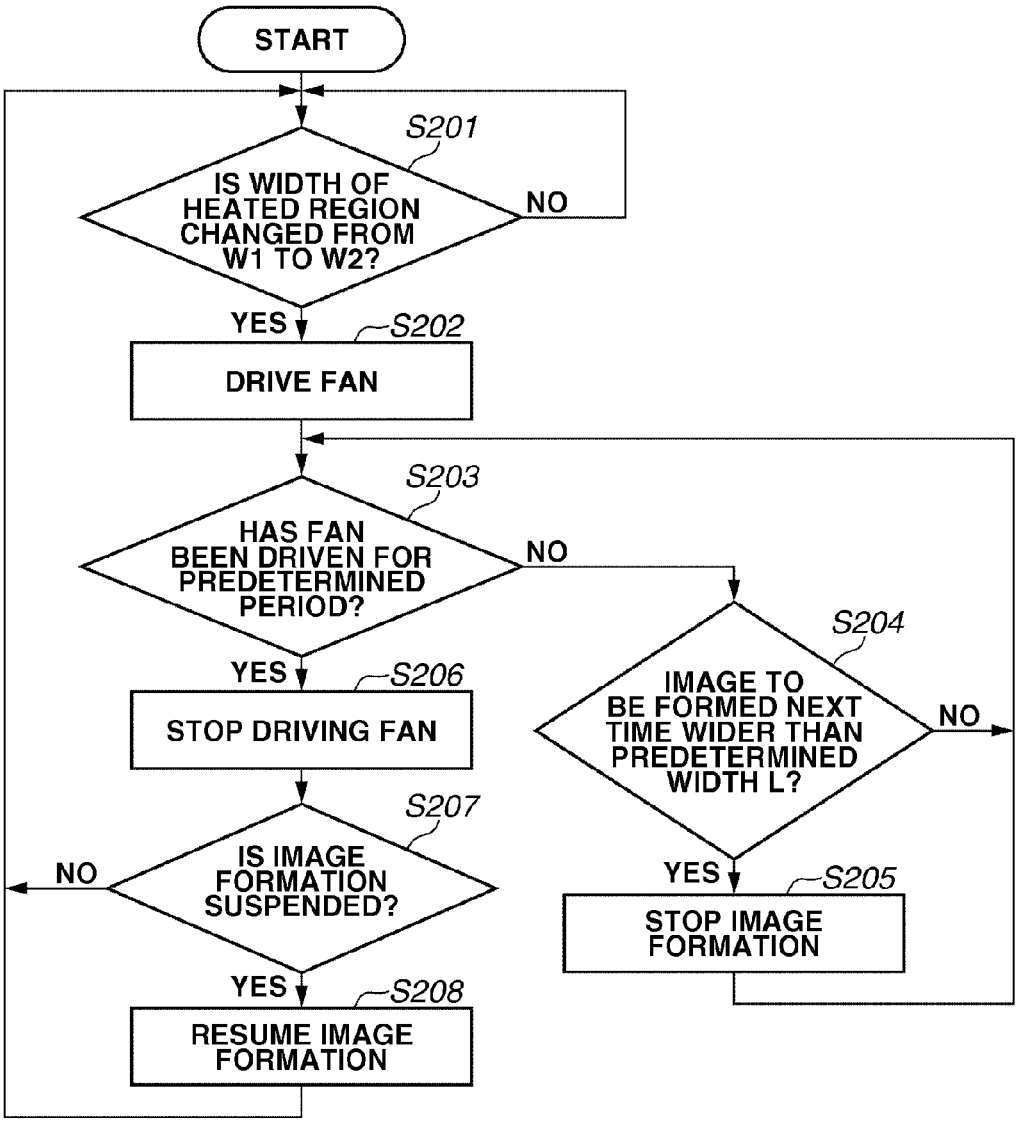
FIG. 6 is a flow chart illustrating the drive control of a fan according to the first exemplary embodiment.

The following describes the drive control of the fan 204 executed in parallel to the processing of the flow chart illustrated in FIG. 5 in a case in which formation of all images is not completed in step S111 in the flow chart of FIG. 5, with reference to the flow chart illustrated in FIG. 6. As described above, in the present exemplary embodiment, when the CPU 201 changes the width of the heated region in the second direction from the width W1 to the width W2, the fan 204 is driven in order to shorten a time required to increase the temperature of the entire region of the width W2 to the predetermined temperature.

If the width of the heated region in the second direction is changed from the width W1 to the width W2 in the flow chart of FIG. 5, the CPU 201 proceeds from step S201 to step S202. In step S202, the CPU 201 drives the fan 204 to supply air to the predetermined region of the pressing roller 2. When the fan 204 cools the predetermined region of the pressing roller 2, the temperature of the first region of the fixing belt 1 is decreased. Thus, the detected temperature of the thermistor TH1 starts decreasing from the target temperature. The CPU 201 decreases the frequency of electric current supplied from the excitation circuit 205 to the excitation coil member 6 such that the temperature T1 detected by the thermistor TH1 does not become lower than the target range, thereby controlling the power supply to the excitation coil member 6 to increase so that the amount of heat generation of the fixing belt 1 is increased.

The foregoing allows the temperature of the first region of the fixing belt 1 to be maintained within the target range while the temperature of the second region of the fixing belt 1 that is not affected by the supply of air from the fan 204 is increased promptly. In other words, while the CPU 201 controls the temperature T1 of the first region of the fixing belt 1 within the target range by the supply of air from the fan 204, the time required for the temperature of the second region of the fixing belt 1 to reach the target range can be shortened.

In step S203, the CPU 201 determines whether the fan 204 has been driven for a predetermined period. The predetermined period is a period from the time when the induction heating device 70 controls the width of the heated region in the second direction to be the width W2 to the time when the temperature of the second region of the fixing belt 1 is changed from room temperature to the target range. The predetermined period is empirically determined in advance. In the present exemplary embodiment, it is assumed that the predetermined period is a period from the time when a recording material S for the first page is fed, to the time when a recording material S for the third page reaches the fixing nip portion N.

In step S203, if the fan 204 has not been driven for the predetermined period, then the CPU 201 proceeds to step S204. In step S204, the CPU 201 determines whether an image to be formed by the image forming units 10*a*, 10*b*, 10*c*, and 10*d* has a wider width than the predetermined width L. If the image to be formed by the image forming units 10*a*, 10*b*, 10*c*, and 10*d* is to be fixed onto a recording material S having a wider width than the predetermined width L, the CPU 201 determines that the image has a wider width than the predetermined width L. In step S204, if the width of the image to be formed by the image forming units 10*a*, 10*b*, 10*c*, and 10*d* is equal to or narrower than the predetermined width L, then the CPU 201 proceeds to step S203.

In step S204, if the image to be formed by the image forming units 10*a*, 10*b*, 10*c*, and 10*d* has a wider width than the predetermined width L, then the CPU 201 proceeds to step S205. In step S205, the CPU 201 stops the image formation operation of the image forming units 10*a*, 10*b*, 10*c*, and 10*d* and then proceeds to step S203. In step S205, the CPU 201 functions as an inhibition unit configured to inhibit formation of an image on a recording material S having a wider width in the second direction than the predetermined width L until a predetermined period has elapsed since the width of the heated region in the second direction was changed from the width W1 to the width W2.

In step S203, if the fan 204 has been driven for the predetermined period, then the CPU 201 proceeds to step S206 to stop driving the fan 204. In the loop from step S203 to step S206, the fan 204 functions as a cooling unit configured to cool the predetermined region of the pressing roller 2 to cool the first region of the fixing belt 1 that is in contact with the pressing roller 2 for the predetermined period. The second direction of the fixing belt 1 is the same as the width direction that is orthogonal to the direction in which the peripheral surface of the fixing belt 1 is moved.

In step S207, the CPU 201 determines whether the image formation operation is suspended. If the image formation operation is not suspended, then the CPU 201 proceeds to step S201 to stand by again until the width of the heated region in the second direction is changed from the width W1 to the width W2.

In step S207, if the image formation operation is suspended, then the CPU 201 proceeds to step S208 to resume the image formation. Then, the CPU 201 proceeds to step S201 to start formation of an image by the image forming units 10*a*, 10*b*, 10*c*, and 10*d* that is to be fixed onto a recording material S having a wider width than the predetermined width L.

The fixing device 16 may also include a thermistor TH2 configured to detect a temperature T2 of the second position of the fixing belt 1. The thermistor TH2 is provided in a region (outer heated region) that is outside a region of the fixing belt 1 that is brought into contact with a recording material S of a minimum size that can be conveyed by the image forming apparatus 100. Further, the outer heated region is inside a region of the fixing belt 1 that is brought into contact with a recording material S of a maximum size that can be conveyed by the image forming apparatus 100. In the present exemplary embodiment, for example, the thermistor TH2 is provided outside the first region of the fixing belt 1.

When the CPU 201 changes the heated region from the first heated region to the second heated region, if the detected temperature T2 of the thermistor TH2 is lower than a predetermined temperature (lower limit of target range) that is lower than a target temperature, the CPU 201 drives the fan 204. The fan 204 cools the predetermined region of the pressing roller 2 so that while the temperature of the first region of the fixing belt 1 is maintained within the target range, the temperature of the second region of the fixing belt 1 can be increased. Even when the CPU 201 changes the first heated region to the second heated region, if the detected temperature T2 of the thermistor TH2 is equal to or higher than the predetermined temperature, the CPU 201 does not drive the fan 204. If the detected temperature T2 of the thermistor TH2 is equal to or higher than the predetermined temperature, then the CPU 201 determines that the temperature of the second region of the fixing belt 1 has reached a temperature (target range) at which an image can be fixed. If the fan 204 cools the predetermined region of the pressing roller 2 although the temperature of the second region of the fixing belt 1 is equal to or higher than the predetermined temperature, the amount of heat generation of the fixing belt 1 is increased to maintain the temperature of the first region of the fixing belt 1 at the target temperature. This causes an increase in the temperature of the second region of the fixing belt 1 that is not in direct contact with the predetermined region of the pressing roller 2 that is to be cooled by the fan 204. Thus, even when the CPU 201 changes the heated region from the first heated region to the second heated region, if the detected temperature T2 of the thermistor TH2 is equal to or higher than the predetermined temperature, the fan 204 is not driven to prevent an excessive increase in the temperature of the second region of the fixing belt 1. The predetermined temperature may be equal to the target temperature.

Alternatively, when the CPU 201 changes the heated region from the first heated region to the second heated region, if the detected temperature T2 of the thermistor TH2 is lower than the detected temperature T1 of the thermistor TH1, the CPU 201 drives the fan 204. In other words, even when the CPU 201 changes the heated region from the first heated region to the second heated region, if the detected temperature T2 of the thermistor TH2 is equal to or higher than the detected temperature T1 of the thermistor TH1, the CPU 201 does not drive the fan 204.

Alternatively, when the CPU 201 changes the heated region from the first heated region to the second heated region, if the detected temperature T2 of the thermistor TH2 is lower than the detected temperature T1 of the thermistor TH1 by at least a threshold value, the CPU 201 may drive the fan 204. In other words, even when the CPU 201 changes the heated region from the first heated region to the second heated region, if the detected temperature T2 of the thermistor TH2 is lower than the detected temperature T1 of the thermistor TH1 and a difference between the detected temperature T2 and the detected temperature T1 is smaller than the threshold value, the CPU 201 does not drive the fan 204.

Alternatively, after the CPU 201 changes the width of the heated region in the second direction from the width W1 to the width W2, if the detected temperature T2 of the thermistor TH2 becomes higher than the detected temperature T1 of the thermistor TH1 by at least the threshold value, the CPU 201 may stop the image formation operation to lower the temperature of the second region of the fixing belt 1. In other words, the CPU 201 changes the width of the heated region in the second direction from the width W2 to the width W1, and another fan (not illustrated) supplies air to another region of the pressing roller 2. A period of air supply from that another fan (not illustrated) to that another region of the pressing roller 2 is set according to the material of the recording material S, the size of the recording material S, the temperature of the fixing device 16, or the humidity. This prevents the temperature of the second region of the fixing belt 1 from becoming an abnormal temperature even when the temperature of the second region of the fixing belt 1 is excessively increased while changing of the width of the heated region in the second direction is repeated.

The fixing device 16 may include a publicly-known movable magnetic flux shielding member between the fixing belt 1 and the excitation coil member 6 to change the heat generation region of the fixing belt 1. In other words, the CPU 201 may be configured to move the magnetic flux shielding member in the direction that is orthogonal to the conveyance direction to change the heated region. Specifically, when the heated region is set to the first heated region, the magnetic flux shielding member is moved to a position between the second region of the fixing belt 1 and the excitation coil member 6. When the heated region is set to the second heated region, the magnetic flux shielding member is moved to a position retracted from between the fixing belt 1 and the excitation coil member 6. When the magnetic flux shielding member is moved to the position between the second region of the fixing belt 1 and the excitation coil member 6, the amount of magnetic flux (magnetic flux density) from the excitation coil member 6 that passes through the second region of the fixing belt 1 can be reduced. This prevents the temperature of the second region of the fixing belt 1 from increasing. In other words, the CPU 201 changes a shielding region where the magnetic flux is shielded by the magnetic flux shielding member.

In the image forming apparatus 100, when the CPU 201 increases the width of the heated region in the second direction according to the width of the recording material S in the direction that is orthogonal to the conveyance direction, while the fixing device 16 increases the width of the heated region in the second direction in advance, the excitation circuit 205 causes the fixing belt 1 to generate heat, and the fan 204 cools the predetermined region of the pressing roller 2 for the predetermined period. Thus, according to the present exemplary embodiment, while the temperature of the first region of the fixing belt 1 is controlled within the target range, the temperature of the second region of the fixing belt 1 is increased, so that the time required for the temperature of the entire region of the fixing belt 1 in the second direction to reach the target range can be shortened.

The present exemplary embodiment is different from the first exemplary embodiment in the points described below. Other elements of the present exemplary embodiment are similar to corresponding elements of the first exemplary embodiment. Thus, description thereof is omitted.

In the first exemplary embodiment, when the fan 204 has been driven for the predetermined period, driving of the fan 204 is stopped on the assumption that the temperature of the entire region of the heated region in the second direction has reached the target range. In the present exemplary embodiment, driving of the fan 204 is stopped when the temperature of the second region of the fixing belt 1 reaches the target range.

Figure 7:
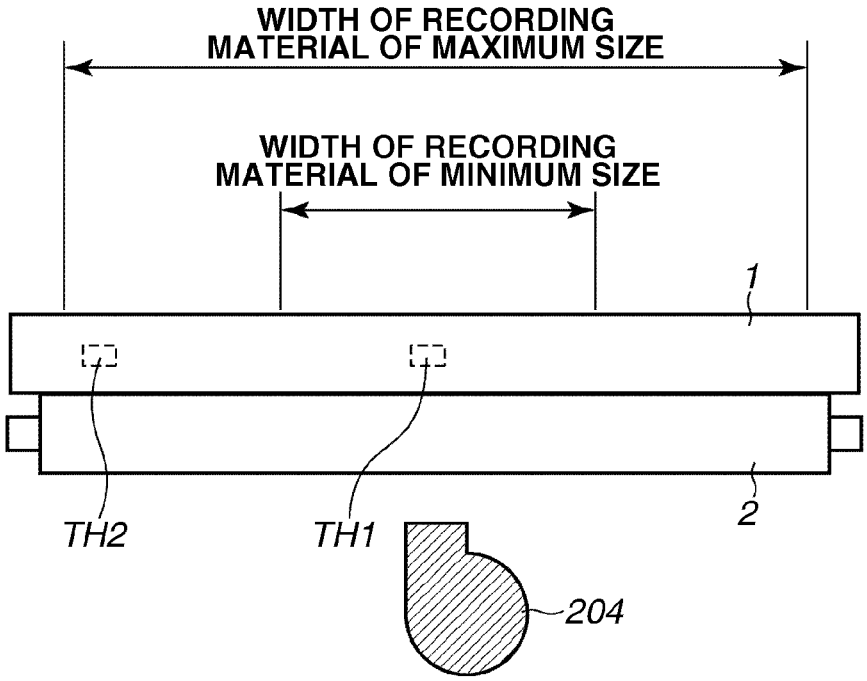
FIG. 7 is a schematic view of a main portion of a fixing device according to a second exemplary embodiment.

FIG. 7 is a schematic view of main portions of the fixing belt 1 and the pressing roller 2 viewed from the upstream side in the conveyance direction. In the present exemplary embodiment, the fan 204 also supplies air to the predetermined region of the pressing roller 2 to lower the temperature of the first region of the fixing belt 1.

The thermistor TH1 is provided at a center of the fixing belt 1 in the second direction. The thermistor TH2 is provided outside (second position) the first region of the fixing belt 1. Specifically, the thermistor TH2 is provided outside a region of the fixing belt 1 that is brought into contact with a recording material S of a minimum size that can be conveyed by the image forming apparatus 100 and within a region of the fixing belt 1 that is brought into contact with a recording material S of a maximum size that can be conveyed by the image forming apparatus 100.

Figure 8:
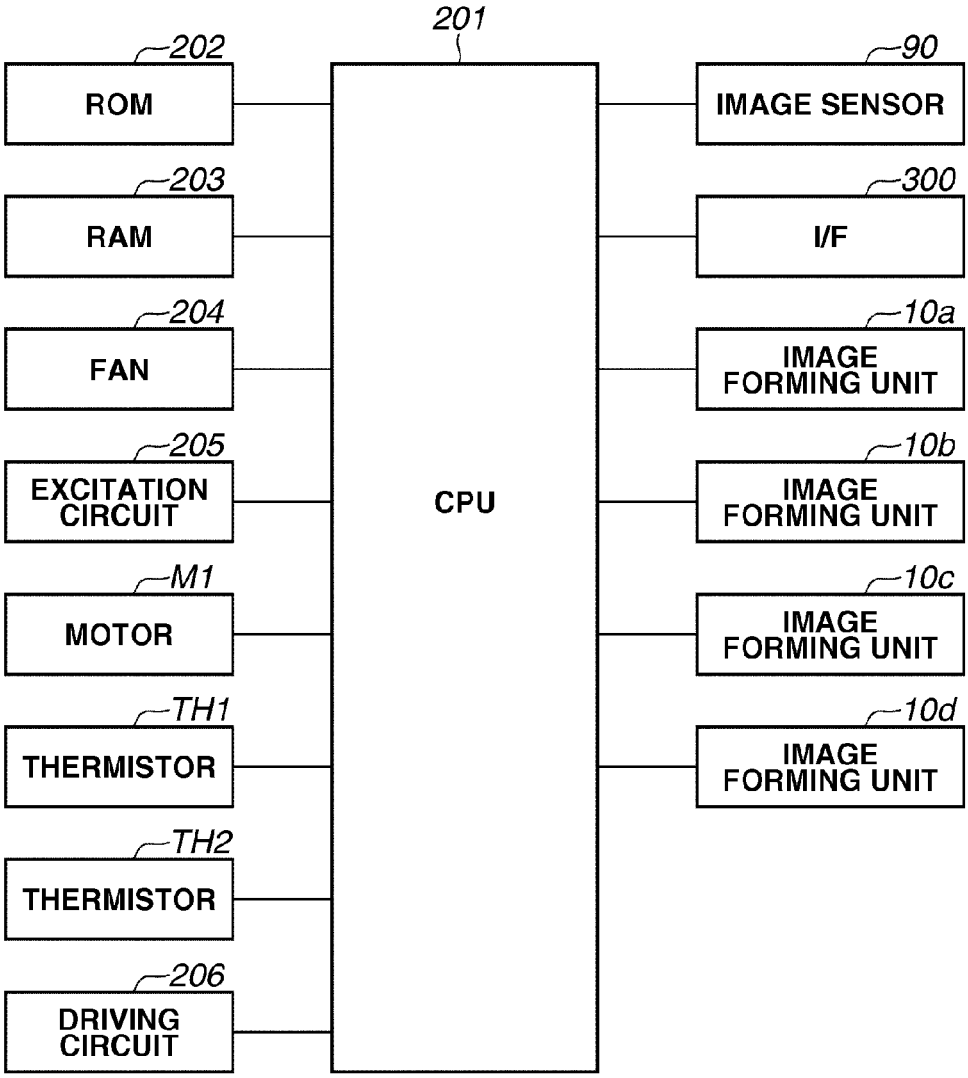
FIG. 8 is a control block diagram of an image forming apparatus according to the second exemplary embodiment.

FIG. 8 is a control block diagram of the image forming apparatus 100 of the present exemplary embodiment.

The thermistor TH1 detects the temperature T1 of the first position of the fixing belt 1 to output first temperature information about the first temperature T1 to the CPU 201. The CPU 201 controls the frequency of electric current input to the excitation coil member 6 by use of the excitation circuit 205 such that the first temperature T1 detected by the thermistor TH1 is within the target range.

The thermistor TH2 detects the temperature T2 of the second position of the fixing belt 1 to output second temperature information about the second temperature T2 to the CPU 201. When the second temperature T2 detected by the thermistor TH2 exceeds an upper limit of the target range, the CPU 201 stops the supply of electric current from the excitation circuit 205 to the excitation coil member 6, whereby the CPU 201 stops generation of heat by the fixing belt 1 before the temperature of the second region of the fixing belt 1 becomes an abnormal temperature (e.g., 200° C. or above).

Members illustrated in FIG. 8 other than the thermistor TH2 are already described above with reference to FIG. 4. Thus, description thereof is omitted in this section.

Figure 9:
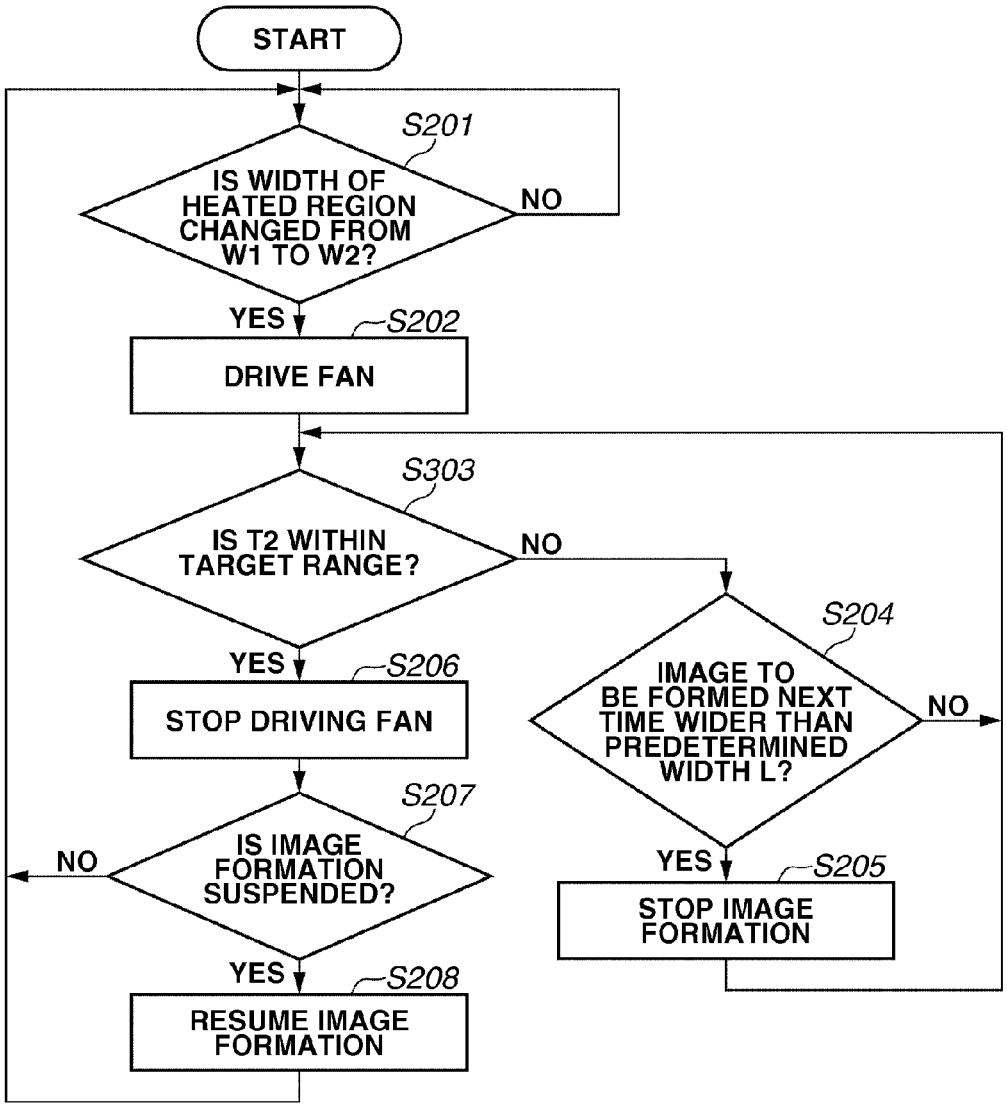
FIG. 9 is a flow chart illustrating the drive control of a fan according to the second exemplary embodiment.

The following describes the drive control of the fan 204 of the present exemplary embodiment, with reference to the flowchart illustrated in FIG. 9. The operation of the CPU 201 at the time of image formation by the image forming apparatus 100 of the present exemplary embodiment is the same as the operation of the CPU 201 at the time of image formation in the first exemplary embodiment illustrated in FIG. 5.

In the present exemplary embodiment, the CPU 201 drives the fan 204 in step S202 and thereafter proceeds to step S303. In step S303, the CPU 201 determines whether the detected temperature T2 of the thermistor TH2 is within the target range. If the detected temperature T2 is not within the target range, then the CPU 201 determines that the temperature of the second region of the fixing belt 1 has not reached a temperature at which an image can be fixed onto a recording material S having a wider width than the predetermined width L.

The thermistor TH2 functions as another temperature detection unit configured to detect the temperature of the second position of the fixing belt 1. The second position corresponds to a position that is outside the width of a recording material S of a minimum size in the second direction of the fixing belt 1 that can be conveyed by the image forming apparatus 100 and is inside the width of a recording material S of a maximum size in the second direction of the fixing belt 1 that can be conveyed by the image forming apparatus 100.

In step S303, if the detected temperature T2 is not within the target range, then the CPU 201 proceeds to step S204. In step S204, the CPU 201 determines whether an image to be formed by the image forming units 10*a*, 10*b*, 10*c*, and 10*d* has a wider width than the predetermined width L. In step S204, if the width of the image to be formed by the image forming units 10*a*, 10*b*, 10*c*, and 10*d* is wider than the predetermined width L, then the CPU 201 proceeds to step S205. In step S205, the CPU 201 stops the image formation operation of the image forming units 10*a*, 10*b*, 10*c*, and 10*d* and then proceeds to step S303. In step S205, the CPU 201 functions as an inhibition unit configured to inhibit formation of an image on a recording material S having a wider width than the predetermined width L, so that fixing of an image onto a recording material S having a wider width than the predetermined width L is inhibited while the detected temperature T2 of the thermistor TH2 has not reached the target range.

In step S204, if the width of the image to be formed by the image forming units 10*a*, 10*b*, 10*c*, and 10*d* is not wider than the predetermined width L, then the CPU 201 proceeds to step S303.

In step S303, if the detected temperature T2 of the thermistor TH2 is within the target range, then the CPU 201 proceeds to step S206. In step S206, the CPU 201 determines that the temperature of the second region of the fixing belt 1 has reached the target range and stops driving the fan 204. The CPU 201 then determines that the fixing device 16 is ready to fix an image onto a recording material S having a wider width than the predetermined width L.

In the image forming apparatus 100, when the CPU 201 increases the width of the heated region in the second direction according to the width of the recording material S in the direction that is orthogonal to the conveyance direction, the excitation circuit 205 causes the fixing belt 1 to generate heat. Then, as the CPU 201 increases the width of the heated region, the CPU 201 starts driving the fan 204. The fan 204 cools another region of the pressing roller 2 until the temperature T2 of the second region of the fixing belt 1 has reached the target range. Thus, according to the present exemplary embodiment, while the temperature of the first region of the fixing belt 1 is controlled within the target range, the temperature of the second region of the fixing belt 1 is increased, so that the time required for the temperature of the entire region of the fixing belt 1 in the second direction to reach the target range can be shortened.

Alternatively, after the CPU 201 changes the width of the heated region in the second direction from the width W1 to the width W2, if the detected temperature T2 of the thermistor TH2 becomes higher than the detected temperature T1 of the thermistor TH1 by at least the threshold value, the CPU 201 may stop the image formation operation to lower the temperature of the second region of the fixing belt 1. In other words, the CPU 201 changes the width of the heated region in the second direction from the width W2 to the width W1, and another fan (not illustrated) supplies air to another region of the pressing roller 2. A period of air supply from that another fan (not illustrated) to that another region of the pressing roller 2 is set according to the material of the recording material S, the size of the recording material S, the temperature of the fixing device 16, or the humidity. This prevents the temperature of the second region of the fixing belt 1 from becoming an abnormal temperature even when the temperature of the second region of the fixing belt 1 is excessively increased while changing of the width of the heated region in the second direction is repeated.

The induction heating device 70 of the first and second exemplary embodiments is configured such that each of the plurality of magnetic cores 7 independently comes close to the excitation coil member 6 and separates from the excitation coil member 6. The induction heating device 70 may be configured such that a portion of the magnetic cores 7 is fixed at a position close to the excitation coil member 6. In other words, the magnetic cores 7 that are inside the width W1 of the heated region in the second direction may be fixed at positions near the excitation coil member 6, and the magnetic cores 7 that are outside the width W1 of the heated region in the second direction may be movable to be close to the excitation coil member 6 and separated from the excitation coil member 6.

The fixing device 16 of the first and second exemplary embodiments is configured such that the width of the heated region in the second direction can be set to one of two widths, the widths W1 and W2. The width of the heated region in the second direction may be adjustable to multiple values of two or more widths. In this case, the CPU 201 may control the width of the heated region in the second direction based on the analysis results of image information, according to a recording material S with the largest width in the second direction among the recording materials S of a predetermined number of pages that are continuously conveyed to the fixing nip portion N.

According to the exemplary embodiments of the present invention, a decrease in image formation productivity can be prevented when a toner image is fixed onto a recording material of an arbitrary width and thereafter a toner image is fixed onto a recording material of a wider width than the arbitrary width.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-196237, filed Sep. 6, 2012, and No. 2013-162391, filed Aug. 5, 2013 which are hereby incorporated by reference herein in their entirety.

What is claimed is:

1. An image forming apparatus comprising:

an image forming unit configured to form an image on a sheet;

a heating member configured to heat the sheet conveyed from the image forming unit for fixing the image onto the sheet;

a temperature detection unit configured to detect a temperature of a predetermined position of a heated region of the heating member;

a controller configured to control the heating member based on the temperature detected by the temperature detection unit;

a heating region control unit configured to control the heated region of the heating member based on a width of the sheet in a width direction orthogonal to a conveyance direction in which the sheet is conveyed, wherein the heating region control unit controls a first heated region if the width of the sheet is equal to or narrower than a predetermined width, wherein the heating region control unit controls a second heated region if the width of the sheet is wider than the predetermined width, wherein the first heated region includes the predetermined position, and wherein the second heated region in the width direction includes the first heated region and an outer heated region outside the first heated region;

a cooling unit configured to cool the heated region:, a coil;

a plurality of cores disposed along the width direction; and a moving unit configured to move each of the plurality of cores to a first position close to the coil or a second position separated from the coil, wherein if the heating region control unit changes the heated region from the first heated region to the second heated region, the cooling unit cools the predetermined position, wherein the heating member generates heat by use of magnetic flux generated by the coil, and wherein the moving unit moves each of the plurality of cores based on a width of the heated region.

2. The image forming apparatus according to claim 1, further comprising:

another temperature detection unit configured to detect a temperature of the outer heated region, wherein in a case where the heating region control unit changes the heated region from the first heated region to the second heated region, if the temperature detected by the another temperature detection unit is lower than a predetermined temperature, the cooling unit cools the predetermined position.

3. The image forming apparatus according to claim 2, wherein the predetermined temperature is determined based on a material of the sheet.

4. The image forming apparatus according to claim 1, further comprising:

another temperature detection unit configured to detect a temperature of the outer heated region, wherein in a case where the heating region control unit changes the heated region from the first heated region to the second heated region, if the temperature detected by the another temperature detection unit is lower than the temperature of the predetermined position, the cooling unit cools the predetermined position.

5. The image forming apparatus according to claim 4, wherein in a case where the heating region control unit changes the heated region from the first heated region to the second heated region, if a difference between the temperature of the outer heated region detected by the another temperature detection unit and the temperature of the predetermined position is larger than a threshold value, the cooling unit cools the predetermined position.

6. The image forming apparatus according to claim 1, wherein in a case where the heating region control unit changes the heated region from the first heated region to the second heated region, the cooling unit cools the predetermined position for a predetermined period.

7. The image forming apparatus according to claim 1, further comprising:

another temperature detection unit configured to detect a temperature of the outer heated region, wherein in a case where the heating region control unit changes the heated region from the first heated region to the second heated region, the cooling unit cools the predetermined position until the temperature detected by the another temperature detection unit becomes the temperature of the predetermined position.

8. The image forming apparatus according to claim 1, further comprising:

a contact member configured to contact the heating member and to be rotationally driven, wherein the cooling unit cools a predetermined region of the contact member that is brought into contact with the predetermined position of the heated region while the contact member is rotationally driven.

9. The image forming apparatus according to claim 1, wherein the heating region control unit changes the heated region from the first heated region to the second heated region while a first sheet is passed through the heated region in a case where the heating member fixes a second image onto a second sheet after the heating member fixes a first image onto the first sheet, wherein a width of the first sheet in the width direction is equal to or smaller than a width of the first heated region in the width direction, and wherein a width of the second sheet in a direction orthogonal to the conveyance direction is larger than the width of the first heated region in the width direction.

10. The image forming apparatus according to claim 1, wherein the heating region control unit includes:

a shielding member configured to shield magnetic flux generated from the coil, wherein the heating region control unit changes a shielding region shielded by the shielding member based on a width of the heated region in the width direction.

11. The image forming apparatus according to claim 1, wherein the cooling unit is a fan.

12. The image forming apparatus according to claim 1, further comprising:

an acquisition unit configured to acquire size information indicating the width of the sheet in the width direction, wherein the heating region control unit controls the heated region based on the size information acquired by the acquisition unit.

13. The image forming apparatus according to claim 1, further comprising:

an inhibition unit configured to inhibit formation of an image on a wide sheet having a wider width than the first heated region until a predetermined period has elapsed since the cooling unit starts cooling the predetermined position.

14. The image forming apparatus according to claim 1, further comprising:

another temperature detection unit configured to detect a temperature of the outer heated region; and an inhibition unit configured to inhibit formation of an image on a wide sheet having a wider width than the first heated region if the temperature detected by the another temperature detection unit exceeds a predetermined temperature.

15. The image forming apparatus according to claim 14, wherein the predetermined temperature is determined based on a material of the sheet.

* * * * *